United States Patent [19]

Yoshikoshi et al.

[11] Patent Number: 4,760,661

[45] Date of Patent: Aug. 2, 1988

[54] COPY STAND

[75] Inventors: Takashi Yoshikoshi, Tokyo; Katsuhira Marumori, Nagareyama; Tsunefusa Gunji, Matsudo, all of Japan

[73] Assignee: Toh Electronics Co., Ltd., Tokyo, Japan

[21] Appl. No.: 871,229

[22] Filed: Jun. 6, 1986

[30] Foreign Application Priority Data

Jun. 28, 1985 [JP] Japan ..... 60-098492[U]
Jul. 5, 1985 [JP] Japan ..... 60-102679[U]
Aug. 27, 1985 [JP] Japan ..... 60-130655[U]

[51] Int. Cl.[4] ..... B41J 11/64

[52] U.S. Cl. ..... 40/356; 40/352; 248/449

[58] Field of Search ..... 40/343, 352, 356, 354; 248/449; 403/157, 158, 161, 162

[56] References Cited

U.S. PATENT DOCUMENTS 375,425 12/1887 Parkinson ..... 40/356
399,503 3/1889 Dean ..... 40/356
415,550 11/1889 McIntire ..... 40/356
595,140 12/1897 Brooks ..... 40/356
1,393,116 10/1921 Guthridge ..... 40/356
1,439,250 12/1922 MacDowell ..... 40/343
1,587,881 6/1926 Webber ..... 248/449
3,030,924 4/1962 Friis-Hansen ..... 40/356
3,095,666 7/1963 Killen ..... 248/449
4,043,064 8/1977 Friedman ..... 40/343
4,433,499 2/1984 Sharber et al. ..... 40/356

FOREIGN PATENT DOCUMENTS 915224 6/1954 Fed. Rep. of Germany ..... 40/356
157510 8/1985 Japan ..... 403/158

*Primary Examiner*—John E. Murtagh
*Assistant Examiner*—Andrew Joseph Rudy
*Attorney, Agent, or Firm*—Armstrong, Nikaido, Marmelstein & Kubovcik

[57] ABSTRACT

A copy stand for shifting a cursor by a motor one line on a copy at a time in which a cursor holder is coupled to bend slightly and sandwich an endless belt driven by the motor. At the driving time by the motor, a coupling force works strongly by a tension of the belt to shift the cursor by the motor and when the cursor is to be returned to its upper end, the cursor can be easily shifted manually while the belt is stopped.

4 Claims, 4 Drawing Sheets

COPY STAND

BACKGROUND TECHNIQUE OF THE INVENTION

This invention relates to a copy stand for use in inputting operation of word processor or computer, and more particualrly to a copy stand capable of shifting one line in a copy at a time by driving a cursor indicating one line with a motor.

The copy stand having one line feeding mechanism is already known heretofore as it is disclosed in U.S. Pat. No. 1,439,250. However, this copy stand has not been developed to such a degree that inspite of its functional character originally, it is not employed currently in a broad range. The reason for such condition is that it seems that various problems on operation remain to be resolved.

The first problem occurs in a returning operation when the input operation of one page to the lower end of the board is completed and the cursor is shifted from the lower end to the upper end of the board. At this time, when the cursor is shifted with a motor, it is time consuming and inefficient. Under the circumstances, as disclosed in U.S. Pat. No. 4,043,064, a structure is proposed in which an endless belt that is driven by the motor is supported by a cursor holder by means of a spring which supports the cursor, and when the one line feeding is carried out, the cursor is shifted together with the endless belt, and when the returning operation is carried out, the cursor holder is pressed down with hand to shift the spring while sliding on the surface of the endless belt. When an operator tries to shift the cursor manually as described in the foregoing, a manipulation character of the returning operation becomes satisfactory. However, in this structure, the spring is interposed, and the strength of the spring must be set in an appropriate condition so that cursor does not slide at one line feeding and does slide easily at the manual operation, but it is difficult to maintain this condition over a long period of time, and because the spring undergoes fatigue and at the one line feeding time, the sliding tends to occur at the one line feeding and thus, the durability is not certain.

The second problem is a difficulty of fixing a copy on a board properly without inclination. The board of the copy stand is normally provided with a lower receiving member at its lower end and a paper holder at its upper end, and the lower end of the copy is abutted on the lower receiving member and the upper end of the copy is fixed by the paper holder. Accordingly, in case a copy whose size matches the board is used, a proper fixing of the copy is possible, but in case, a smaller copy is used, the lower end of the copy is floated and the upper end is fixed by the paper holder which does not allow the copy to be properly fixed, the copy being easily slant to make the indication of the cursor totally meaningless. By the way, there is a structure in which instead of using the paper holder for fixing even a small size copy by abutting on the lower receiving member, the upper end of the copy is retained on the board by means of a magnet, but this system cannot be used for a thick copy.

The third problem occurs when a copy is exchanged or a page of a copy is turned over. In these cases, the cursor must be removed off the board. In the conventional copy stand, the cursor is removed by pulling out of the cursor holder or the cursor is slightly lifted from the cursor holder to turn upward along the board to prevent the cursor from abutting on the paper holder. The manipulation character of these methods is extremely poor without exception. Also, there is a structure in which the cursor is bent in a direction perpendicular to the board and is arranged to leap towards the operator, but the copy stand is positioned in front of the face of the operator so that the operator is required to be stepped back allowing the leaping of the cursor, and thus, this system is not easy to handle.

This invention is completed for the purpose of making the copy stand having a one line feeding mechanism to be easy to handle and of practicing the manipulation character completely.

Namely, a primary object of this invention is to allow the returning operation of the cursor by manual operation which gives a sufficient durability while improving the manipulation character.

The second object of this invention is to fix copies of different sizes on the board of the copy stand properly.

The third object of this invention is to remove the cursor off the board easily and quickly with satisfactory manipulation character in case of exchanging copies.

SUMMARY OF THE INVENTION

Namely, this invention is characterized in that in a copy stand, a cursor holder for supporting a cursor indicating one line of a copy on a board and an endless belt provided at one end of the board and being driven by a motor are connected, and the motor is operated by a manipulation of a foot switch and the like to shift the cursor one line at a time, the improved copy stand in which the cursor holder holds the endless belt by slightly bending it, and the cursor holder and the endless belt being firmly coupled by a tension of the endless belt at the drive by the motor, and being weakly coupled at the non-drive by the motor.

Furthermore, this invention includes a copy stand in which a lower receiving member of the board is detachable, and a lower end of copies of different sizes is supported by changing a mounting position of the lower receiving member.

Moreover, this invention includes a copy stand in which a bending shaft extending in an oblique direction is provided on a stem portion of the cursor, and the cursor is allowed to leap upwardly while it being separated off the board.

BRIEF DESCRIPTION OF THE DRAWINGS

The drawings show an embodiment of this invention.

DETAILED DESCRIPTION OF THE INVENTION

This invention will be described in the following in detail by referring to appended drawings.

Figure 1:
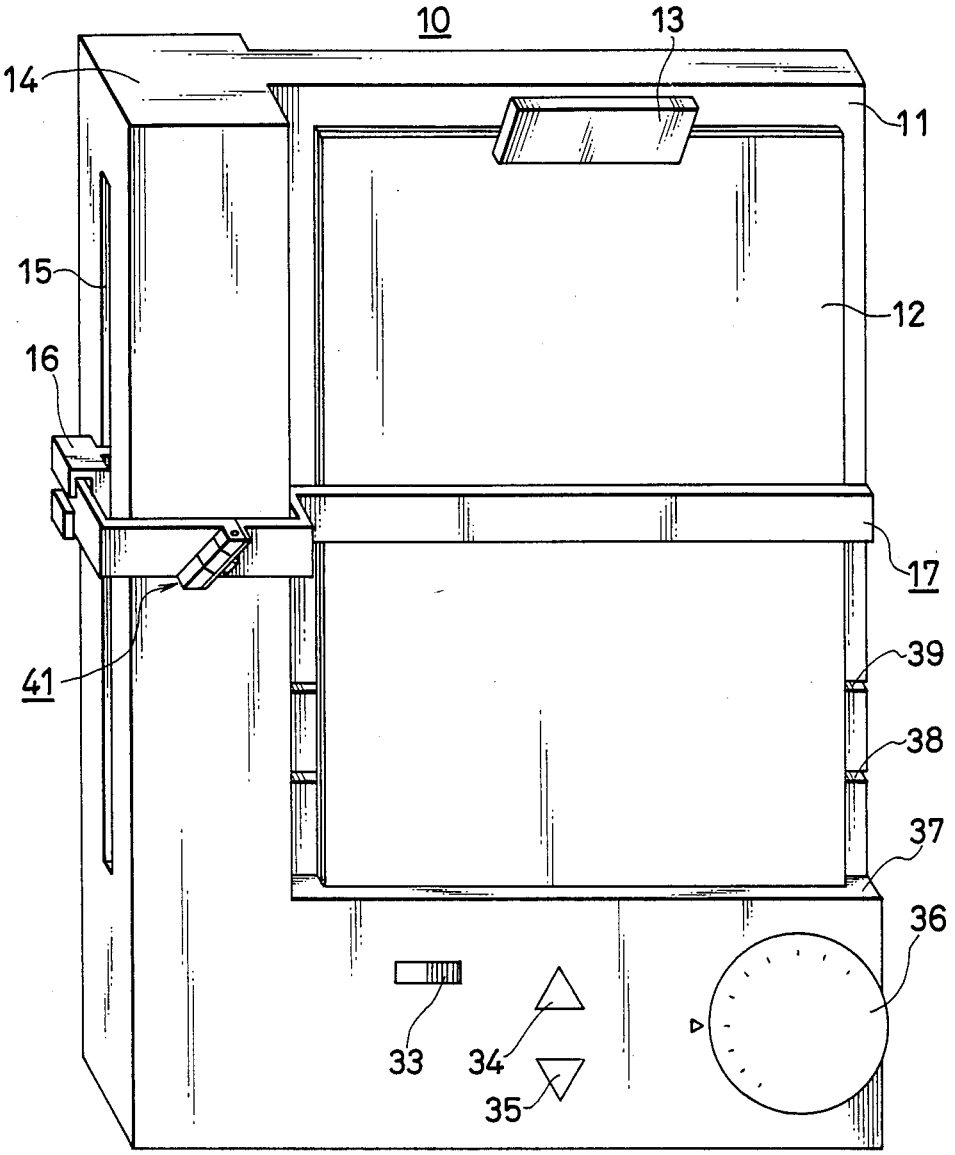
FIG. 1 is a perspective view showing a whole copy stand.

In the copy stand 10 of FIG. 1, numeral 11 denotes a board, and a copy 12 is mounted on this board, and is retained by a paper holder 13. A drive unit chamber 14 is provided at the side of the board 11, and a cursor holder 16 projects through a slit 15 from the drive unit chamber 14, and one end of a cursor 17 indicating one line of the copy 12 is inserted into and supported by this cursor holder 16.

Figure 2:
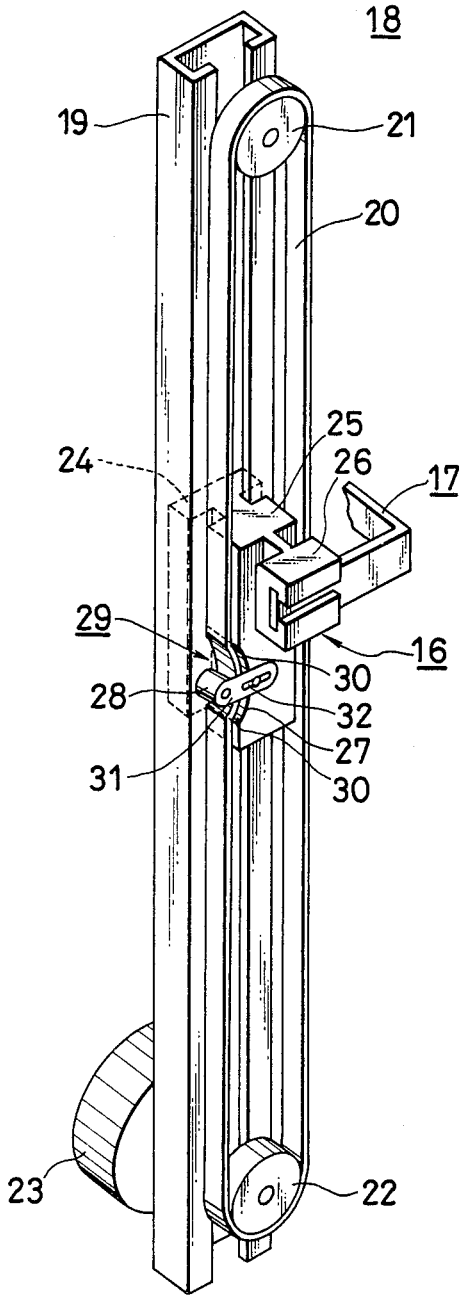
FIG. 2 is a perspective view of a removed drive portion of this copy stand when viewed from a reverse surface side of the portion.

FIG. 2 shows a condition of viewing a drive portion 18 accommodated in the drive unit chamber 14 which is removed therefrom and from the reverse side of the board 11, and in this drawing, numeral 19 denotes a guide member, and said member having an almost C-shaped cross section and extending in a vertical direction along the side of the board 11. Numeral 20 denotes a rubber made endless belt, and is spanned between pulleys 21 and 22 provided at an upper and lower end of the guide member 19, and is driven by a motor 23 coupled to the pulley 22 of the lower end. A portion 24 of the cursor holder 16 is fitted to the inside of the guide member 19, and is positioned in a space between a middle portion 25 and the belt 20, and the cursor 17 is supported as its tip portion projects from the slit 15, and is guided by the guide member 19 to shift vertically. A strong coupling portion 29 consisting of a rigid concave portion 27 provided to the middle portion 25 and a rigid bar 28 is provided at one end surface of a lower portion of the middle portion 25 so that the belt 20 is slightly bent and is pressed toward the concave portion. The belt 20 is sandwiched by being alternately pressed at three locations of the end portions 30, 30 of the rigid concave portion 27 and the rigid bar 28. By the way, the bar 28 is mounted by screwing a support plate 31 to the middle portion 25, and the force of sandwiching the belt 20 can be adjusted by changing the screwing position along a long hole 32 of the support plate 31.

The motor 23 is connected to a control device (not shown in the drawing), and the actuation of the motor is carried out by a power source switch 33 in the lower part of the board 11, and clockwise rotation and counterclockwise rotations are carried out by manipulation of an ascend switch 34, descend switch 35 and foot switch (not shown in the drawing) or clockwise rotation by a set fixed amount is carried out by a dial 36.

This drive portion 18 has the foregoing construction so that the operation becomes as follows. When the motor 23 is operated by the manipulation of each switch, the belt 20 is driven, and at the same time, the tension is worked on the belt 20, and a large frictional force works between the coupling portion 29 and the belt 20, and the cursor holder 16 and the cursor 17 together with the belt 20 are shifted in the upper or lower direction. Also, in order to return the cursor 17 in the upper direction, when the cursor holder 16 is pressed by hand, the coupling portion 29 is easily slid since no tension is working on the belt 20, and thus, the cursor holder 16 and the cursor 17 can be freely moved while the belt 20 is stopped.

Accordingly, this drive portion 18 couples strongly the coupling portion 29 and the belt 20 by using the tension of the belt 20 when the cursor 17 is moved by the motor 23 so that this coupling force is not deteriorated by the use of a long period of time and thus, has an excellent durability.

Figure 3:
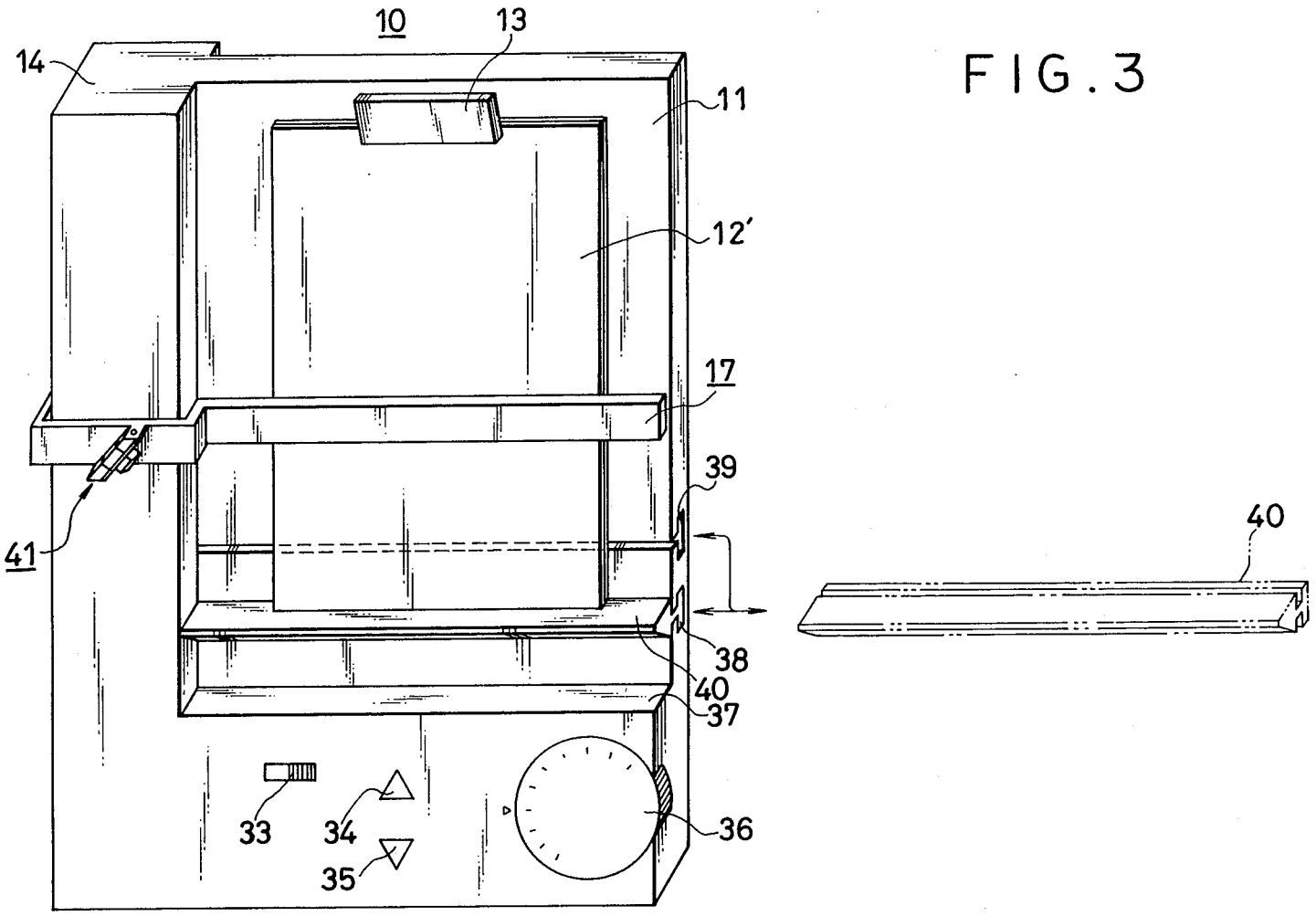
FIG. 3 is a perspective view of the case where a small size copy is mounted on this copy stand.

Furthermore, in the copy stand 10, the board 11 is provided with a lower receiving member 40 capable of inserting and mounting detachably into slits 38, 39 provided on the surface of the board 11 as shown in FIG. 3 besides a lower receiving member 37 provided at its lower end.

Therefore, in case of fixing a large size copy 12, as shown in FIG. 1, it is arranged in such a way that the lower end of the copy 12 abuts on the lower receiving member 37 without using the detachable lower receiving member 40 and in case of fixing a small size copy 12', the lower receiving member 40 is mounted in either slits 38, 39 by matching the size of the copy as shown in FIG. 3, and the lower end of the copy 12' abuts on the lower receiving member 40 so that the copy 12' is fixed. When it is used in such a way, the lower end of the copy abuts always on the lower receiving member regardless of the size of the copy so that the copy can be retained in a proper condition without tilting.

Figure 4:
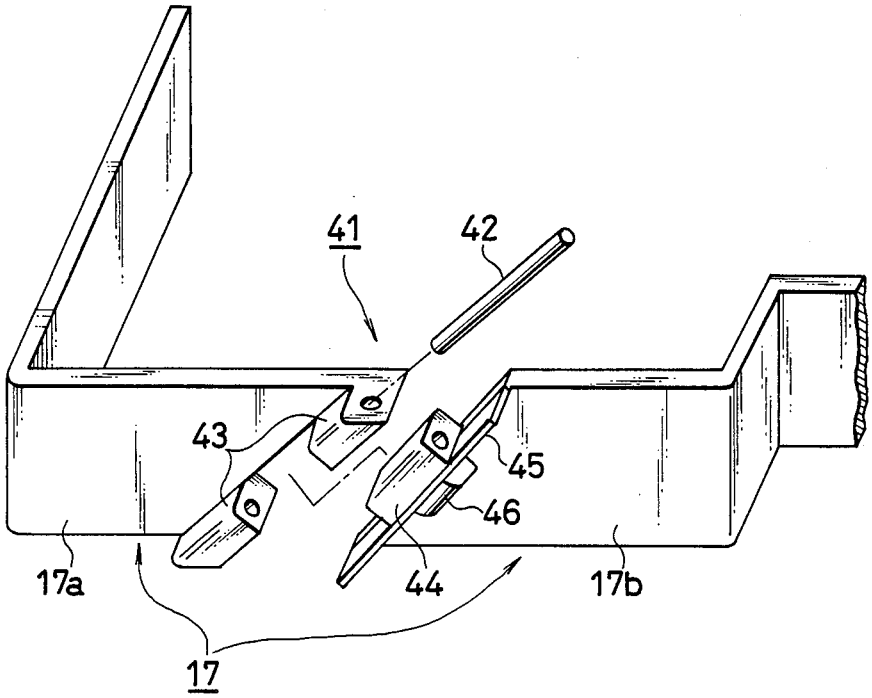
FIG. 4 is an exploded perspective view showing a bending shaft portion of a cursor.
Figure 5:
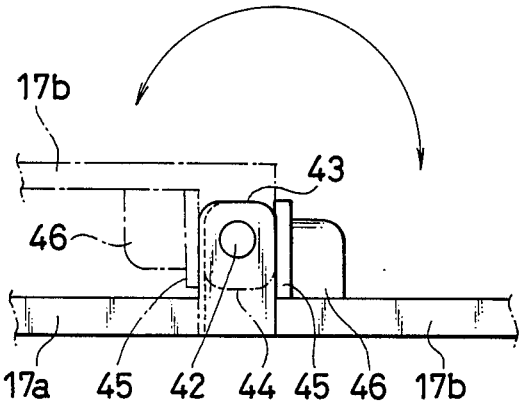
FIG. 5 is a drawing for explanation of operation of the bending shaft portion of the cursor.

Also, in the copy stand 10, a bending shaft 41 is formed at a stem portion of the cursor 17. This bending portion 41 couples a stem side portion **17*a* and a tip side portion 17*b* of the cursor 17 by means of a pin 42 extending in a slant direction as shown in FIGS. 4 and 5, and a tip of the cursor 17 is separated from the board 11, and can be bent or folded in an oblique direction to be extended in the upper direction. Furthermore, an outer periphery of a pin receiver 41 of the stem side portion 17*a* becomes almost a square shape, and a plate spring 45 is retained and fixed on a pin receiver 44 of the tip side portion 17*b* by means of a holding piece 46, and this plate spring 45 contacts the outer periphery of the pin receiver 43 and the tip side portion 17*b* of the cursor 17 is arranged to be click stopped in a condition where the copy 12 is retained on the board 11**, and a condition where it is lifted towards the operator and a condition where it is extended in the upper direction.

Accordingly, this cursor 17 can leap the tip of the cursor 17 in the upper direction of the board by drawing the tip of the cursor 17 towards the operator in case of turning over the pages of the copy, and the cursor 17 can be removed off the board instantly without changing the posture of the operator's body even in a condition where his face approaches the board.

As described in the foregoing, the copy stand 10 is an embodiment of this invention, and various modifications to this embodiment are possible without changing the gists of this invention.

For example, any type of the coupling portion 19 that can slightly bend and hold the belt can be used as long as it can sandwich the belt at two points or more than four points. Also, the lower receiving member 40 can be mounted by inserting into the board like a slide type, and another type of the lower receiving member that can be urged against the surface of the board to be fitted may be used, and furthermore, the bending shaft 41 may be of type that does not use the plate spring 45.

What is claimed is:

1. A copy stand comprising: a board for mounting a copy, a cursor for indicating one line of copy on said board, a cursor holder for supporting said cursor and shifting said cursor along one end of said board, said cursor holder having a rigid curved coupling portion, an endless belt, a motor driving said endless belt, control means for actuating said motor and coupling means including a rigid element bending said endless belt over said rigid curved coupling portion and pressing said endless belt against said cursor holder whereby said cursor is more strongly coupled with said endless belt when said endless belt is driven by said motor and less strongly coupled and movable relative to said endless belt when said motor is not driving said endless belt.

2. A copy stand according to claim 1 wherein said element is a bar movable relative to said cursor holder to adjust the tension between said endless belt and said cursor holder and further including means for fixing said bar relative to said cursor holder.

3. A copy stand according to claim 1 further including a lower receiving member and a plurality of vertically spaced grooves on said board for receiving said lower receiving member at different locations on said board.

4. A copy stand according to claim 1 wherein said cursor is comprised of a stem portion supported by said cursor holder and a tip portion and said stem portion and tip portion are hinged together by means of a pin disposed at an angle which permits the tip portion to be lifted off said board and folded toward an upper portion thereof.

* * * * *